US007985916B2

(12) United States Patent
Shibata

(10) Patent No.: US 7,985,916 B2
(45) Date of Patent: Jul. 26, 2011

(54) ELECTRONIC WIND INSTRUMENT AND ZERO POINT COMPENSATION METHOD THEREFOR

(75) Inventor: Koichiro Shibata, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/860,257

(22) Filed: Sep. 24, 2007

(65) Prior Publication Data

US 2008/0072746 A1 Mar. 27, 2008

(30) Foreign Application Priority Data

Sep. 22, 2006 (JP) ..... 2006-256543

(51) Int. Cl.
*G10H 1/00* (2006.01)

(52) U.S. Cl. ..... 84/621; 84/615; 84/653

(58) Field of Classification Search ..... 84/615, 84/621, 653

See application file for complete search history.

(56) References Cited

U.S. PATENT DOCUMENTS 3,886,929 A * 6/1975 Hoppesch et al. ..... 600/532
4,038,895 A * 8/1977 Clement et al. ..... 84/687
4,119,007 A * 10/1978 Criglar et al. ..... 84/730
4,702,141 A * 10/1987 Bonanno ..... 84/626
4,971,049 A * 11/1990 Rotariu et al. ..... 128/204.21
5,125,315 A 6/1992 Kawashima
5,479,920 A * 1/1996 Piper et al. ..... 128/204.23
5,929,319 A * 7/1999 King et al. ..... 73/23.3
5,929,361 A 7/1999 Tanaka
2002/0017300 A1* 2/2002 Hickle et al. ..... 128/204.22
2005/0288722 A1* 12/2005 Eigler et al. ..... 607/9
2007/0095347 A1* 5/2007 Lampotang et al. ..... 128/204.23

FOREIGN PATENT DOCUMENTS

EP 0312061 A2 4/1989
JP 1-103889 U 7/1989
JP 09-006352 A 1/1997
JP 2002-278556 A 9/2002

OTHER PUBLICATIONS

Yamaha WX5 Wind MIDI Controller Owner's Manual; XP-002419055; pp. 1-42.
Extended search report issued in corresponding European patent application No. 07018515.2-2225; dated Dec. 20, 2007.
The First Office Action issued in corresponding Chinese Patent Application No. 200710153490.9 dated Feb. 12, 2010.
Notice of Grounds for Rejection issued in corresponding Japanese Patent Application No. 2006-256543 dated Feb. 15, 2011.

* cited by examiner

*Primary Examiner* — David S. Warren
(74) *Attorney, Agent, or Firm* — Rossi, Kimms & McDowell LLP

(57) ABSTRACT

Electronic wind instrument includes: a breath flow detector detecting a flow of breath blown by a user; a tone generator forming a tone signal; a control section controlling the tone generator on the basis of an output signal of the breath flow detector; and a zero point compensation section that, when a predetermined condition has been satisfied, compensates a zero point of the output signal of the detector on the basis of the output signal generated by the detector at the time point the predetermined condition has been satisfied. The predetermined condition is satisfied when it is detected that a zero point compensation switch operable by the user has been turned on, that no performance is being executed by the user, that a value indicated by the output signal of the detector has decreased below a predetermined threshold value, or that the wind instrument has been turned on.

13 Claims, 6 Drawing Sheets

ELECTRONIC WIND INSTRUMENT AND ZERO POINT COMPENSATION METHOD THEREFOR

BACKGROUND OF THE INVENTION

The present invention relates to an electronic wind instrument, such as an electronic flute, and a zero point compensation method for the electronic wind instrument.

Generally, electronic wind instruments are provided with a pressure sensor for detecting a blowing (or playing) pressure applied by a user (or human player). Note-on and note-off timing control and volume control for tone formation is performed on the basis of a blowing pressure detected by the pressure sensor. Among relevant prior art literatures concerning saxophone-type or recorder-type electronic wind instruments are Japanese Patent Application Laid-open Publication Nos. HEI-9-6352 and 2002-278556.

In a saxophone-type or recorder-type electronic wind instrument, a human player (or user) performs the instrument by putting a pipe section of the instrument in their mouth to form a closed space between the pipe and the mouth and blowing breath (air) into the closed space; thus, the blowing pressure can be efficiently converted into an electrical signal via a pressure sensor provided in the closed space. Therefore, even when a temperature drift in a zero point of an output signal of the pressure sensor occurs, such a temperature drift has only a slight influence on the performance. Note that the "zero point" is an output value of the pressure sensor when the blowing pressure is zero. However, in flute-type electronic wind instruments (hereinafter referred to as "electronic flutes") etc., which are performed by a human player blowing breath air into an open space, a breath flow detection section for detecting a flow of human player's breath is provided in the open space. Because the breath flow detection section converts the human player's breath flow into a pressure in the open space and converts the pressure sensor into an electric signal by means of a pressure sensor, a conversion efficiency in converting the player's breath flow into the final electrical signal is very poor. Thus, the breath flow detection section amplifies the output signal of the pressure with a high gain and thereby generates an electrical signal indicative of the breath flow. As a consequence, the zero point of the output signal of the breath flow detection section tends to easily move or shift due to a temperature drift. If the zero point shifts to a minus (negative) side, note-on (tone generation start) of a tone tends be difficult, while, if the zero point moves to a plus (positive) side, a tone tends to keep sounding even after the end of a player's performance of the instrument. Namely, the conventionally-known electronic wind instruments, such as an electronic flute, present the problem that a performance would be interfered with shifting, due to a temperature drift, of the zero point of the output signal of the breath flow detection section.

SUMMARY OF THE INVENTION

In view of the foregoing, it is an object of the present invention to provide an improved electronic wind instrument and zero point compensation method therefor which allow a human player to execute a comfortable performance even in a situation where the zero point of the output signal of a breath flow detector is liable to shift due to a temperature drift.

In order to accomplish the above-mentioned object, the present invention provides an improved electronic wind instrument, which comprises: a breath flow detector that detects a flow of breath blown by a user; a tone generator that forms a tone signal; a control section that controls the tone generator on the basis of an output signal of the breath flow detector; and a zero point compensation section that, when a predetermined condition has been satisfied, compensates a zero point of the output signal of the breath flow detector on the basis of the output signal generated by the breath flow detector at the time point the predetermined condition has been satisfied.

According to the present invention arranged in the aforementioned manner, upon satisfaction of the predetermined condition, compensation of the zero point of the output signal of the breath flow detector is performed on the basis of the output signal generated by the breath flow detector at the time point the predetermined condition has been satisfied. Thus, even in a situation where the zero point of the breath flow data is liable to shift due to a temperature drift and the like, the human player is allowed to execute a comfortable performance.

In a preferred embodiment of the present invention, several conditions listed below are set as examples of the "predetermined condition":

a) operation, by the user (or player), of a zero point compensation switch;
b) detection of a state when no performance is being executed by the user;
c) detection of a state where the value indicated by the output signal of the breath flow detector has decreased below a predetermined threshold value and there can be seen an apparent zero point shift; and
d) turning-on (or powering-on) of the electronic wind instrument.

In the present invention, the zero point compensation may be performed in accordance with two schemes. Namely, according to the first scheme, upon satisfaction of a predetermined condition, the output signal generated by the breath flow detector at the time point the predetermined condition has been satisfied is set as the zero point of the output signal of the breath flow detector. According to the second scheme, there is provided a shift control device that shifts the output signal of the breath flow detector in a plus or minus direction. When the predetermined condition has been satisfied, the zero point compensation section controls an amount of shifting, by the shift control device, of the output signal of the breath flow detector so that the output signal of the breath flow detector, having been shift-controlled by the shift control device, takes a predetermined value.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

First Embodiment

Figure 1:
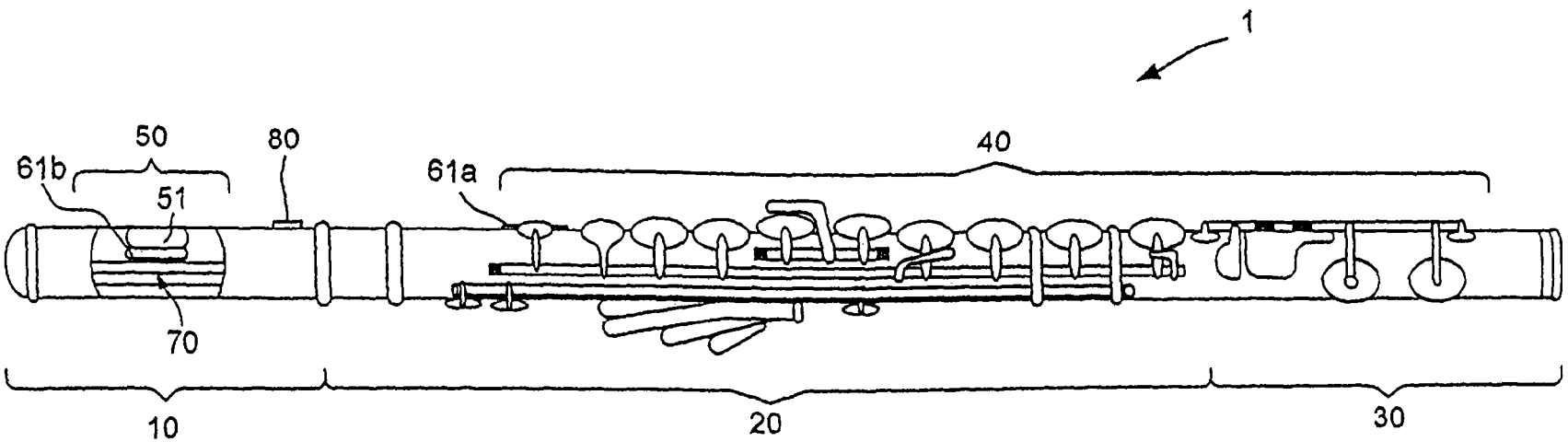
FIG. 1 is a view showing an outer appearance of an electronic flute constructed as a first embodiment of an electronic wind instrument of the present invention.

FIG. 1 is a view showing an outer appearance of an electronic flute that is constructed as a first embodiment of an electronic wind instrument of the present invention. As shown, the electronic flute of FIG. 1 includes a casing 1 that has a head pipe section 10, main pipe section 20 and tail pipe section 30. Performing keys 40, which are operators operable with fingers of a human player (user), are provided on the main pipe section 20 and tail pipe section 30, and a lip plate 50, which is an operator operable with lips of the human player, is provided on the head pipe section 10. Blow hole 51 is provided in the lip plate 50, and a breath flow detector 70 is provided on the lip plate 50. The breath flow detector 70 detects a flow (i.e., flow rate or amount) of breath air blown by the human player into the electronic flute through the blow hole 51 and thereby outputs breath flow data.

Figure 2:
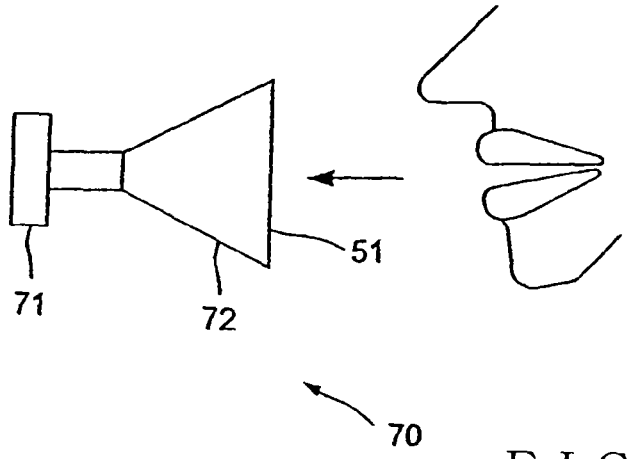
FIG. 2 is a view explanatory of how a breath flow detector in the electronic flute is constructed.

FIG. 2 is a view explanatory of how the breath flow detector 70 is constructed. The breath flow detector 70 includes a pressure sensor 71, and a jet collector 72 that is a cone-shaped mechanism for receiving a flow of breath blown and introduced through the blow hole 51, and directing the received breath flow to the pressure sensor 71. Breath flow data is output on the basis of an output signal of the pressure sensor 71. Main characteristic feature of the instant embodiment resides in a technique pertaining to zero point compensation performed during processing of the breath flow data output from the breath flow detector 70.

In the instant embodiment, the zero point compensation is started up at any one of a plurality of predetermined timing (i.e., upon satisfaction of a plurality of predetermined conditions). The first timing is when the electronic flute has been turned on. The second timing is when the human player has given an instruction for performing the zero point compensation. To capture such second timing, a zero point compensation switch 80 is provided on the casing 80 at a position (in the illustrated example, at a position on the head pipe section 10 sufficiently distant from the lip plate 50) where the provision of the compensation switch 80 does not interfere with performance operation by the player. The zero point compensation switch 80, which is turned on by the human player to instruct the start of the zero point compensation, may be constructed in any desired manner as long as it does not interfere with performance operation by the player. The third timing is when it can be judged that the human player is not performing the electronic flute. To capture such third timing, not only a touch detecting sensor 61*a*, such as a membrane switch or touch sensor, for detecting a touch of a left hand finger of the human player, is provided on the main pipe section 20, but also a touch detecting sensor 61*b*, such as a membrane switch or touch sensor, for detecting a touch of a lip of the human player is provided on the lip plate 50. The fourth timing is when an apparent temperature drift can be seen in the breath flow data output from the breath flow detector 70.

Figure 3:
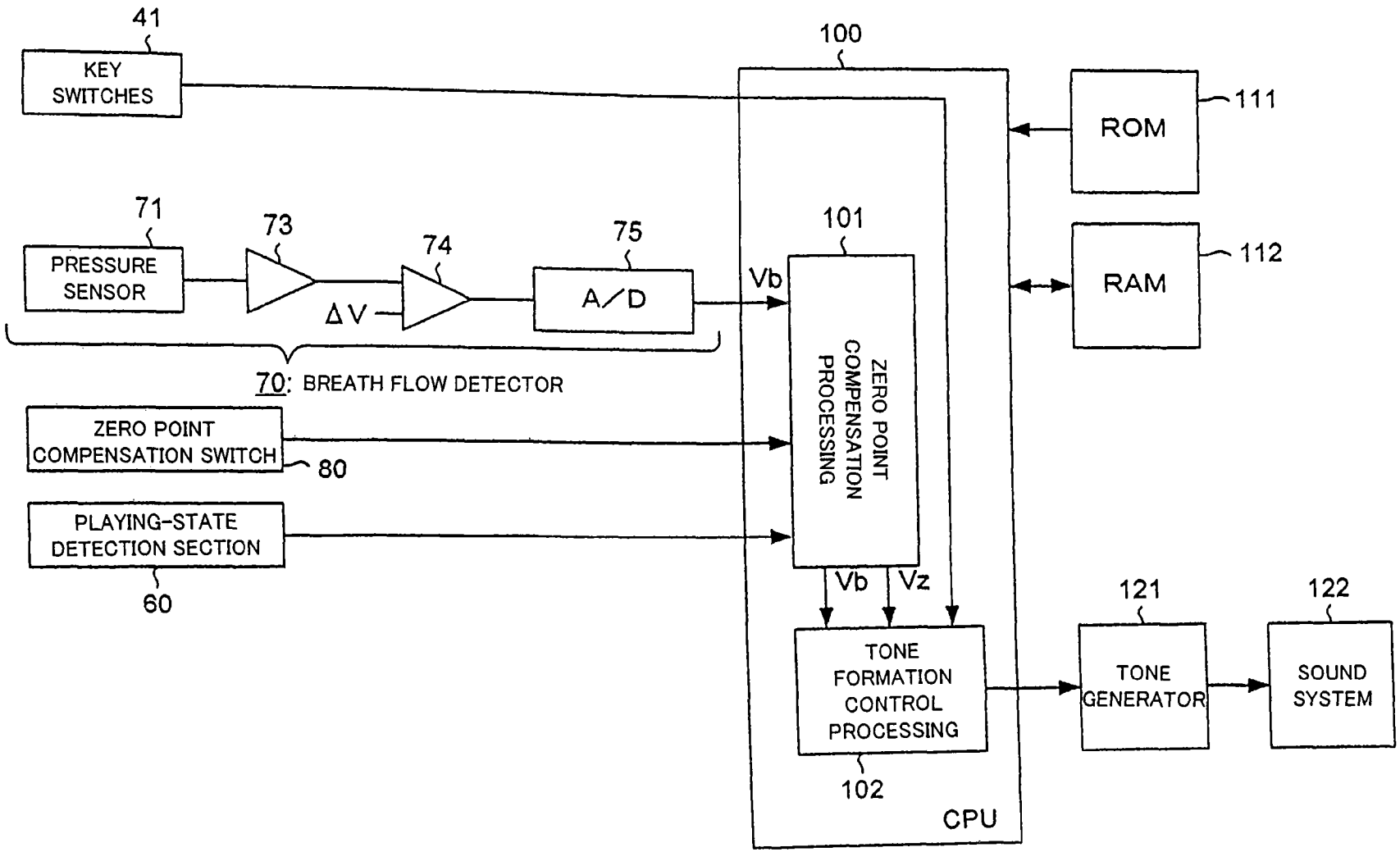
FIG. 3 is a block diagram showing a general electrical setup of the electronic flute according to the first embodiment of the present invention.

FIG. 3 is a block diagram showing a general electrical setup of the electronic flute according to the first embodiment of the present invention. Group of key switches 41 comprises a plurality of key switches that are turned on/off by the corresponding performing keys provided on the main pipe section 20 and tail pipe section 30 as noted above.

The breath flow detector 70 includes, in addition to the pressure sensor 71 and jet collector 72 shown in FIG. 2, an amplifier 73 for amplifying an output signal of the pressure sensor 71, an adder 74 for shifting the operating or working point of the amplifier 73 (i.e., output signal generated by the amplifier 73 when a signal indicative of a zero pressure has been given from the pressure sensor 71) in a plus (positive) direction by a predetermined fixed voltage $\Delta V$ (in this case, $\Delta V=0.5$ V), and an A/D converter 75 for converting the output signal of the adder 74 into digital representation and outputting the converted digital output signal as breath flow data Vb. The pressure sensor 71 comprises a bridge circuit including a strain gauge that receives, via the jet collector 72, a flow of breath (air) blown by the player. The reason why the working point of the amplifier 73 is shifted, via the adder 74, in the plus (positive) direction by the fixed voltage $\Delta V$ (=0.5 V) is as follows. Namely, in the instant embodiment, the output signal of the amplifier 73 will not fall below 0 V because the control circuitry of the electronic flute shown in FIG. 3 is provided by a single power supply. However, a drift occurs in the pressure sensor 71, and a temperature drift, although considerably slight in amount, occurs in the amplifier 73. If a drift that shifts the output signal of the amplifier 73 in the plus direction has occurred, an output signal generated by the amplifier 73 while no breath air is being blown will float above 0 V, and thus, there may be employed an approach for treating the output signal of the amplifier 73 at that time as the zero point. However, if a drift that shifts the output signal of the amplifier 73 in the minus direction has occurred, such an approach can not be employed. Because, in the case where a drift shifting the output signal of the amplifier 73 in the minus direction has occurred, an increase in the pressure applied to the pressure sensor 71 will not appear as an increase in the output signal of the amplifier 73 unless a pressure exceeding a pressure corresponding to the shift is given to the pressure sensor 71. To avoid such a situation, the instant embodiment is arranged to give the positive offset $\Delta V$ to the output signal of the amplifier 73 so that, when the pressure applied to the pressure sensor 71 has increased only a little above zero, the output signal of the amplifier 73 can increase in value accordingly. The reason why the offset $\Delta V$ is set at 0.5 V is that the offset $\Delta V$ has to be 0.5 V in order to avoid influences of a temperature drift of the pressure sensor 71 although the offset $\Delta V$ may be smaller than 0.5 V if only a temperature drift of the amplifier 73 is considered.

Playing state detection section 60 includes the above-mentioned touch detecting sensors 61*a* and 61*b* of FIG. 1, and a circuit for outputting a non-playing-state signal, indicating that no performance being executed by the human player, when a state where at least one of the touch detecting sensors 61*a* and 61*b* is OFF has lasted for more than a predetermined time.

CPU 100 controls the entire electronic flute of the present invention. ROM 111 is a read-only memory having prestored therein various control programs to be executed by the CPU 100. RAM 112 is used by the CPU 100 as a working area therefor. Tone generator 121 is a device that generates a tone signal under the control of the CPU 100. Sound system 122 audibly reproduces or sounds the tone signal generated by the tone generator 121.

In FIG. 3, there are shown, as processes to be performed in accordance with the control programs stored in the ROM 111, i.e. zero point compensation processing 101 and tone formation control processing 102. Upon turning-on (powering-on) of the electronic flute, parallel execution of the zero point compensation processing 101 and tone formation control processing 102 is started by the CPU 100. The zero point compensation processing 101 is processing for passing breath flow data Vb, given from the breath flow detector 70, to the tone formation control processing 102, generating zero point data Vz, intended for zero point compensation, at any one of the above-mentioned four timing (i.e., upon satisfaction of any one of the four conditions) and then passing the thus-generated zero point data Vz to the tone formation control processing 102 to cause the tone formation control processing 102 to identify the zero point of the breath flow data Vb. The tone formation control processing 102 is processing for generating parameters for determining pitches of tones to be generated on the basis of ON/OFF states etc. of key switches of the key switch group 41, generating parameters for controlling note-on timing, note-off timing, tone volume, etc. on the basis of the breath flow data Vb and zero point data Vz given via the zero point compensation processing 101 and then supplying the thus-generated parameters to the tone generator 121 to cause the tone generator 121 to form a tone signal. For example, tone generation is controlled using, as blowing or playing pressure data, a difference between the breath flow data Vb and the zero point data Vz.

Figure 4:
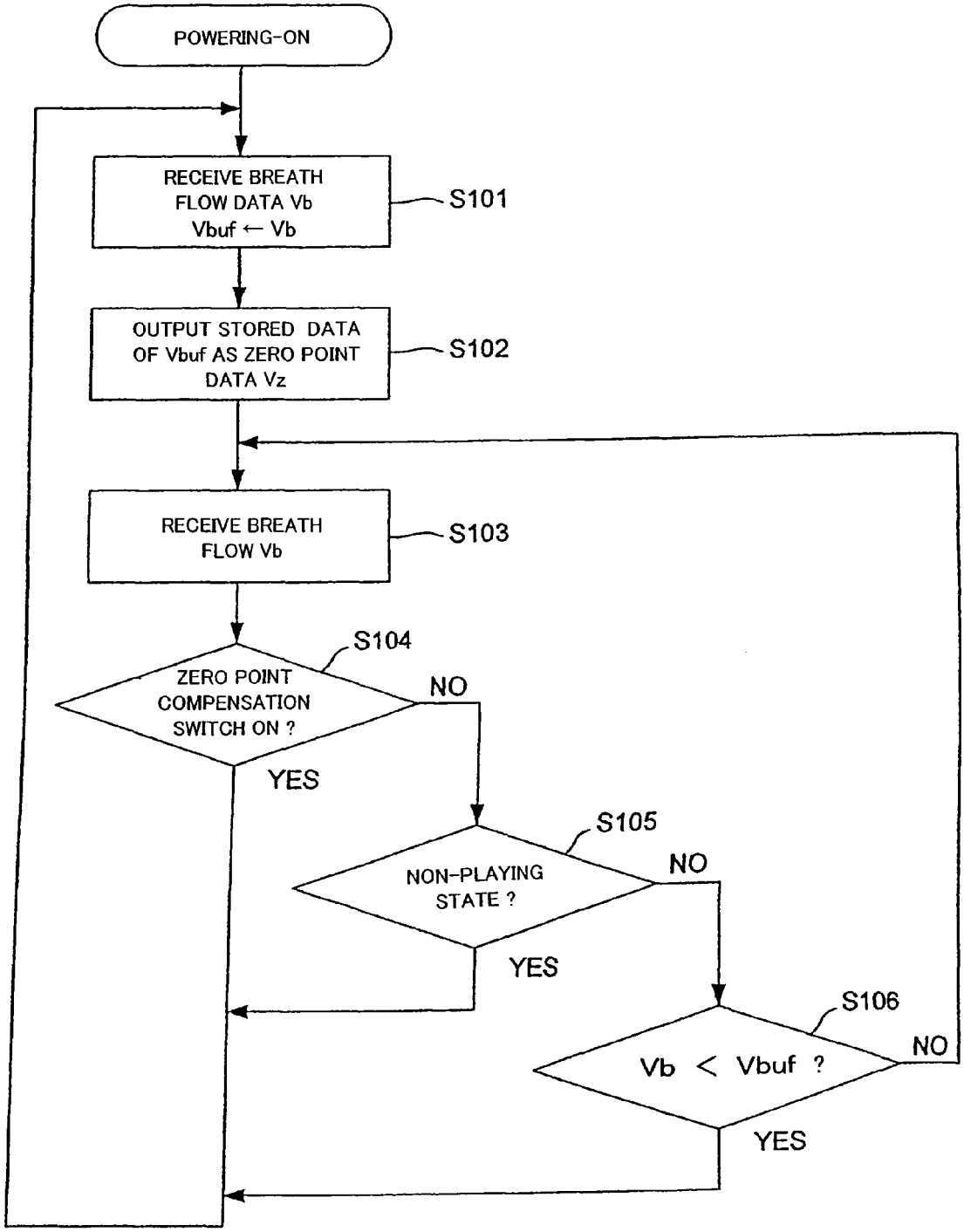
FIG. 4 is a flow chart showing an example operational sequence of zero point compensation processing performed in the first embodiment.

FIG. 4 is a flow chart showing an example operational sequence of the zero point compensation processing 101 performed in the instant embodiment. Upon turning-on (powering-on) of the electronic flute, the CPU 101 starts parallel execution of the zero point compensation processing 101 and tone formation control processing 102. First, at step S101 of the zero point compensation processing 101, breath flow data Vb is received from the breath flow detector 70 and then not only passed to the tone formation control processing 102 but also stored into a buffer Vbuf. Then, the stored data of the buffer Vbuf is passed, as zero point data Vz, to the tone formation control processing 102, to cause the tone formation control processing 102 to identify the value of the zero point data as the zero point of the breath flow data Vb (step S102). In this manner, the zero point compensation is performed in response to the powering-on of the electronic flute (i.e., at the first timing).

Next, breath flow data Vb is received from the breath flow detector 70 and passed to the tone formation control processing 102, at step S103. Then, a determination is made, at step S104, as to whether the zero point compensation switch 80 is currently ON. With a NO determination at step S104, a determination is made, at step S105, as to whether a non-playing-state signal is being output from the playing state detection section 60. With a NO determination at step S105, a further determination is made, at step S106, as to whether the breath flow data Vb received from the breath flow detector 70 is smaller in value than the stored data of the breath flow data Vb. With a NO determination at step S106, the CPU 100 reverts to step S103 to repeat the aforementioned operations at and after step S103. As long as the zero compensation switch 80 is OFF, no non-playing state signal is being output and the breath flow data Vb received from the breath flow detector 70 is greater in value than the stored data of the buffer VBUF, a NO determination is made at each of steps S104-S106, so that the operations of steps S103-S106 are repeated. During that time, the zero point data Vz does not vary, and the breath flow data Vb output from the breath flow detector 70 is passed to the tone formation control processing 102 via step S103 of the zero point compensation processing 101.

If the zero point of the breath flow data Vb has shifted to the plus side during a performance of the electronic flute due to a temperature drift and the like, breath flow data Vb greater than the value indicated by the zero point data Vz is passed to the tone formation control processing 102, so that there arises the inconvenience that a tone undesirably keeps sounding even when the blowing pressure is zero, i.e. even when the human player is not performing the electronic flute. If, on the other hand, the zero point of the breath flow data Vb has shifted to the minus side due to a temperature drift and the like, there arises the inconvenience that a time delay occurs before note-on (i.e., generation start) of a tone following a blowing action by the human player. In these cases, the human player can cause the electronic flute to perform zero point compensation by turning on the zero point compensation switch 80, and thereby avoid the inconveniences. Namely, if the zero point compensation switch 80 is turned on, a YES determination is made at step S104 once the zero point compensation processing 101 has arrived at step S104, so that the operations of steps S101 and S102 are carried out. As a consequence, the breath flow data Vb received from the breath flow detector 70 is not only stored into the buffer Vbuf but also passed, as zero point data Vz, to the tone formation control processing 102 (this is the zero point compensation performed at the second timing i.e. upon satisfaction of the second condition). Thus, even when the zero point of the breath flow data Vb has shifted due to a drift and the like, the zero point data Vz is automatically compensated to a value corresponding to the shifted zero point, so that the aforementioned inconveniences can be avoided.

Generally, the aforementioned zero point compensation is generally performed in accordance with a player's intention. However, in the instant embodiment, the zero point compensation is sometimes performed automatically irrespective of a player's intention. For example, if the hands and lips are held out of touch with the electronic flute for more than a predetermined time period, a non-playing state signal is output from the playing state detection section 60. At that time, the breath flow data Vb output from the breath flow detector 70 takes a value corresponding to a zero blowing pressure because the electronic flute is not being performed. Thus, the instant embodiment is constructed to perform the zero point compensation in such a situation. Namely, once a non-playing state signal is output from the playing state detection section 60, a YES determination is made at step S105 once the zero point compensation processing 101 has arrived at step S105, so that the operations of steps S101 and S102 are carried out (this is the zero point compensation performed at the third timing, i.e. upon satisfaction of the third condition). If the zero point of the breath flow data Vb has shifted to the minus side during a performance of the electronic flute due to a temperature drift and the like, the breath flow data Vb received from the breath flow detection section 70 when the blowing pressure is zero becomes smaller than the value stored in the buffer Vbuf. In this case, a YES determination is made at step S106 once the zero point compensation processing 101 has arrived at step S106, so that the operations of steps S101 and S102 are carried out (this is the zero point compensation performed at the fourth timing, i.e. upon satisfaction of the fourth condition).

The first embodiment arranged in the above-described manner can achieve the advantageous benefit that, even in a situation where the zero point of the breath flow data Vb is likely to shift due to a temperature drift and the like, the human player is allowed to execute a comfortable performance through the zero point compensation performed automatically or in response to operation of the zero point compensation switch 80.

Second Embodiment

Figure 5:
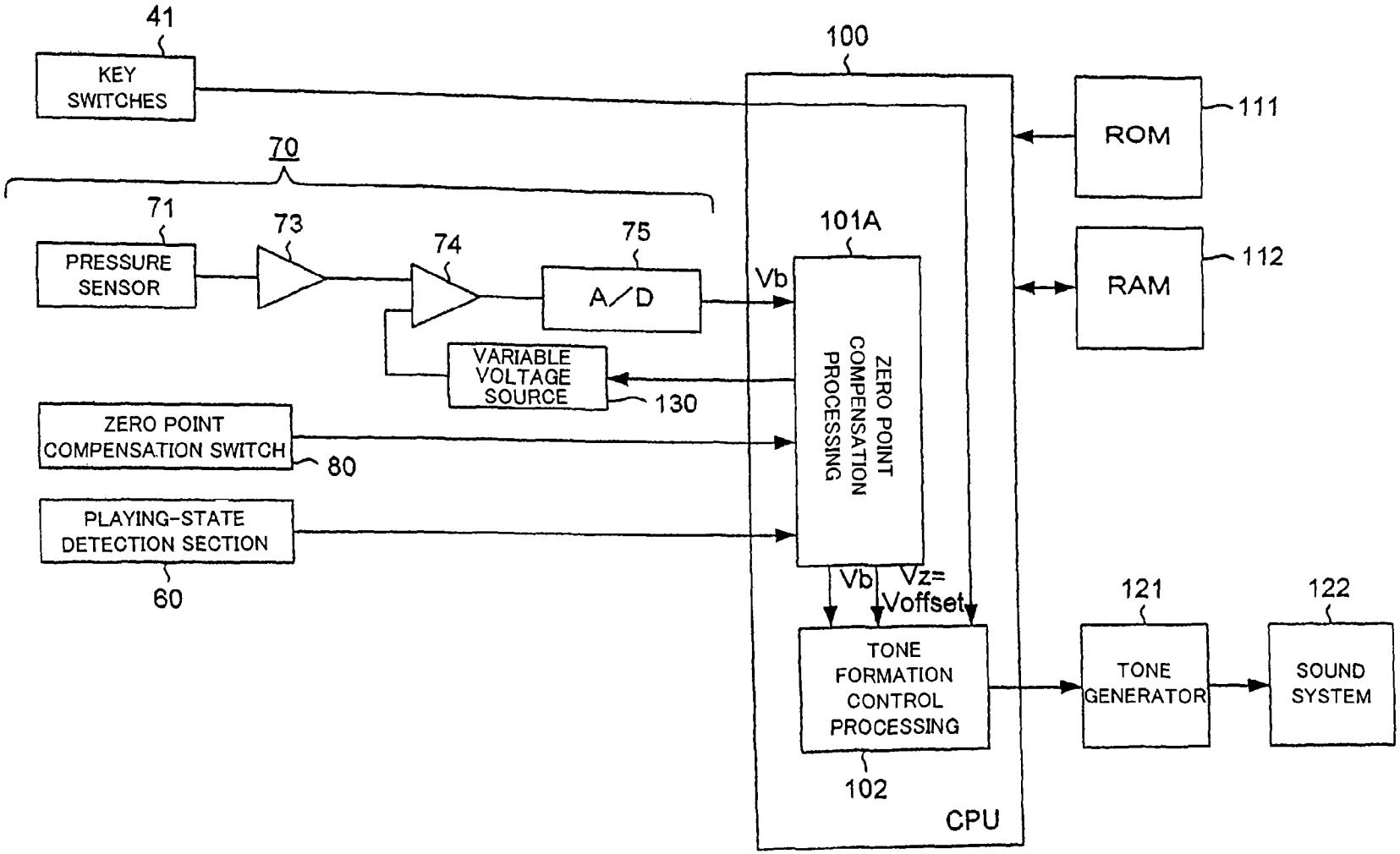
FIG. 5 is a block diagram showing a general electrical setup of an electronic flute according to a second embodiment of the present invention.

FIG. 5 is a block diagram showing a general electrical setup of an electronic flute according to a second embodiment of the present invention. Elements corresponding in construction and function to those in the first embodiment of FIG. 3 are indicated in FIG. 5 by the same reference numerals and will not be described to avoid unnecessary duplication.

The electronic flute according to the second embodiment includes a variable voltage source 130 as a power supply for supplying the adder 74 of the breath flow detector 70 with an offset-canceling voltage. Here, the adder 74 and variable voltage source 130 together constitute a shift control section (or device) for shifting output information, i.e. breath flow data Vb, of the breath flow detector 70 in the plus or minus direction. In the second embodiment, the CPU 100 performs zero point compensation processing 101A in place of the zero point compensation processing 101 employed in the first embodiment. The zero point compensation processing 101 in the first embodiment is arranged to capture the first to fourth timing at which the pressure applied to the pressure sensor 71 of the breath flow detector 70 is assumed to be zero and perform the zero point compensation for compensating the zero point (i.e., zero point data Vz) of breath flow data Vb, to be identified by the tone formation control processing 102, to agree with the breath flow data Vb output at that time point. By contrast, in the zero point compensation processing 101A, the zero point data Vz, to be identified by the tone formation control processing 102, is constantly fixed at a predetermined offset value Voffset, and an output voltage of the variable voltage source 130 is compensated, at any one of the first to fourth timing (i.e., upon satisfaction of the first to fourth conditions), so that the breath flow data Vb itself equals the predetermined offset value Voffset. Namely, whereas the zero point compensation processing 101 in the first embodiment compensates the zero point for the tone formation control processing 102 to interpret the breath flow data Vb, the zero point compensation processing 101A in the second embodiment performs the zero point compensation of the breath flow data Vb by compensating a shifting amount of the above-mentioned shift control section so that the breath flow data Vb equals the predetermined offset value Voffset.

Figure 7:
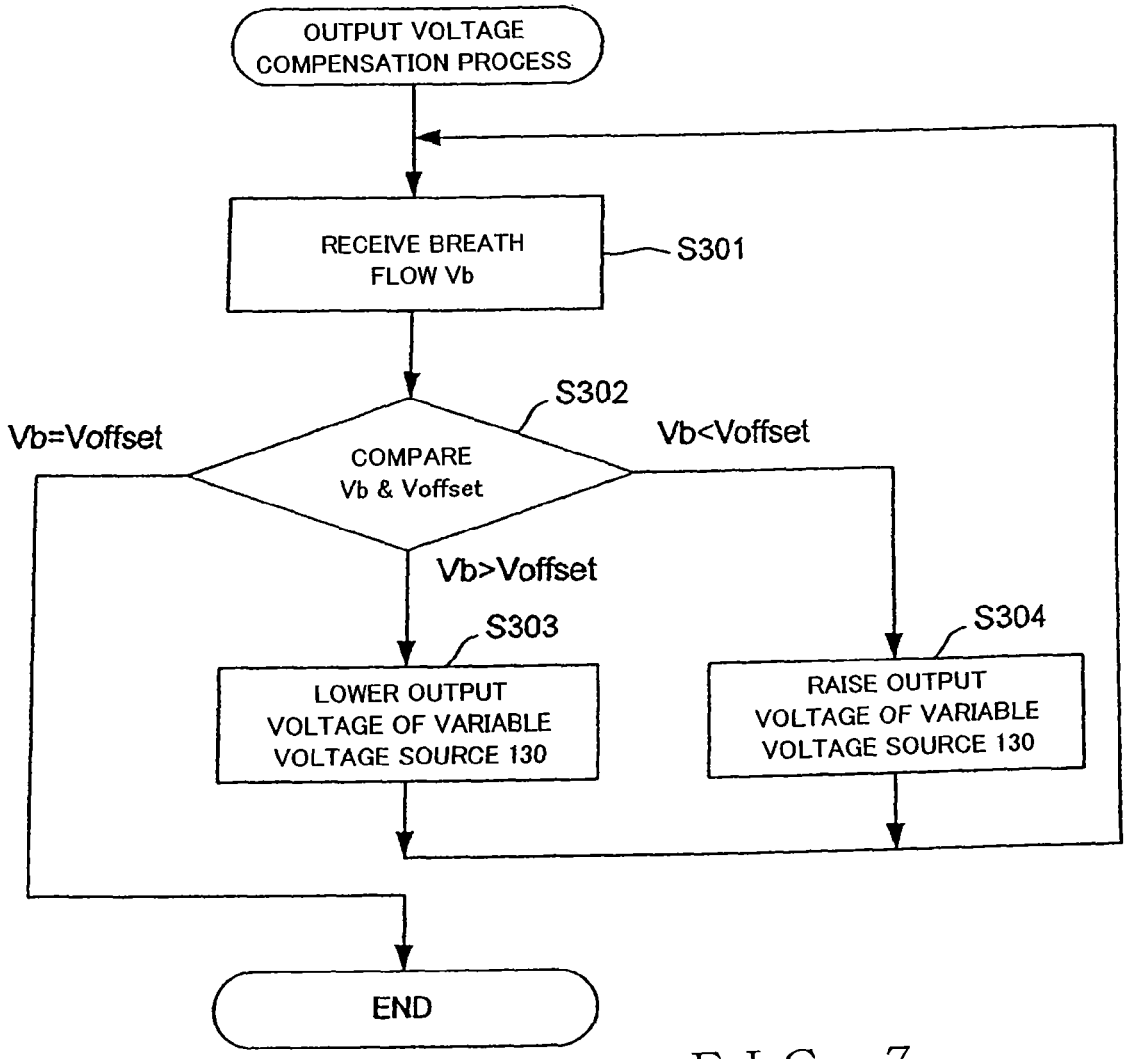
FIG. 7 is a flow chart showing an example detailed operational sequence of an output voltage compensation process performed in the zero point compensation processing of FIG. 6.
Figure 6:
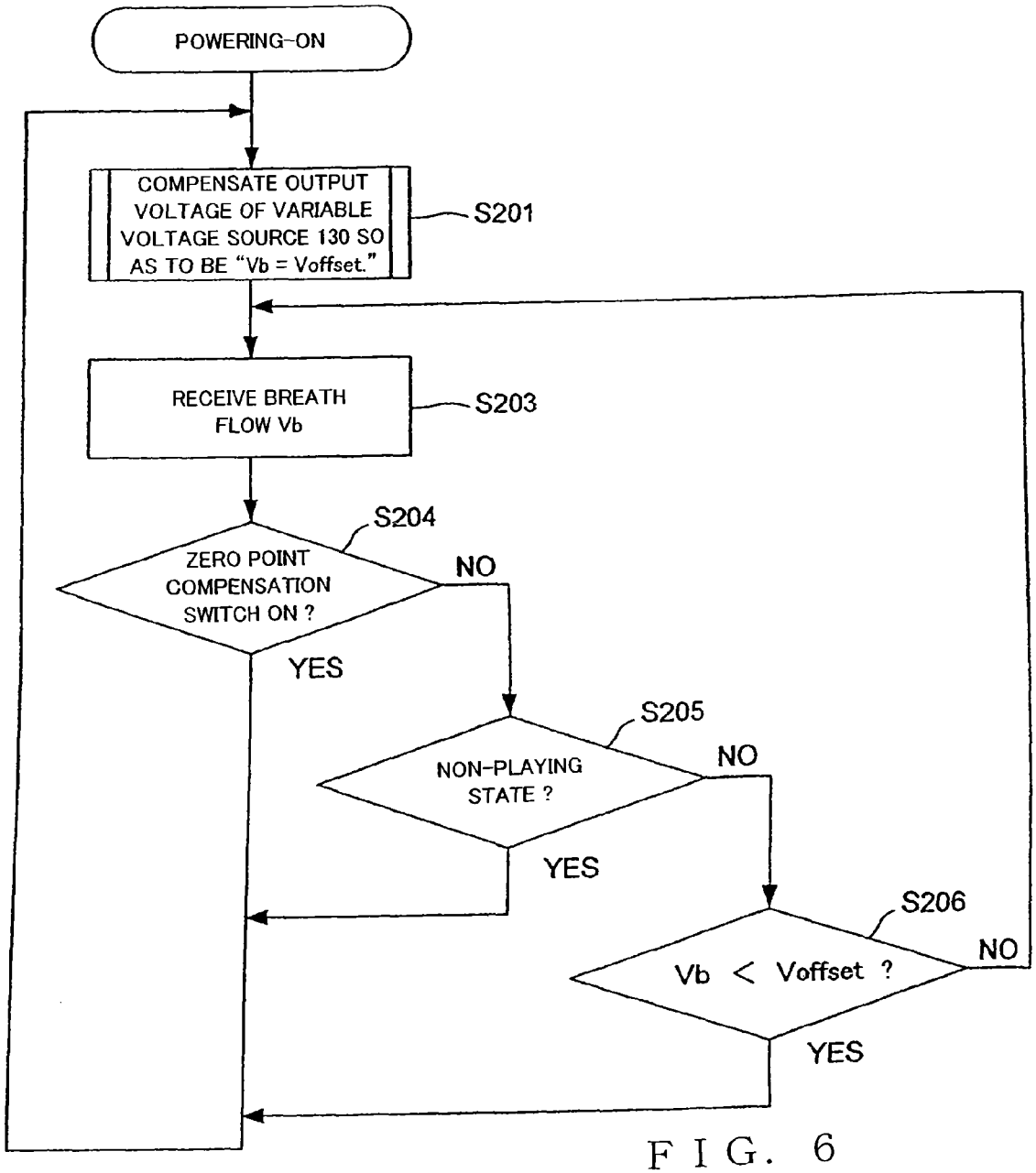
FIG. 6 is a flow chart showing an example operational sequence of zero point compensation processing performed in the second embodiment.

FIG. 6 is a flow chart showing an example operational sequence of the zero point compensation processing 101A performed in the second embodiment. At step S201 of FIG. 6, the output voltage of the variable voltage source 130 is compensated so that the breath flow data Vb itself equals the predetermined offset value Voffset. This output voltage compensation process is performed at any one of the first to fourth timing (i.e., upon satisfaction of the first to fourth conditions) similarly to the aforementioned operations of steps S101 and S102 in the first embodiment. FIG. 7 is a flow chart showing an example detailed operational sequence of the output voltage compensation process performed at step S201. In the illustrated example of the output voltage compensation process, breath flow data Vb is received from the breath flow detector 70 at step S301. If Vb>Voffset as determined at step S302, the output voltage of the variable voltage source 130 is lowered at step S303, after which the CPU 100 reverts to step S301. If Vb<Voffset as determined at step S302, the output voltage of the variable voltage source 130 is raised at step S304, after which the CPU 100 reverts to step S301. Such operations are repeated until the breath flow data Vb equals the offset value Voffset. Once the breath flow data Vb equals the offset value Voffset (Vb=Voffset) through the repetition, the output voltage compensation process of step S201 of FIG. 6 is brought to an end, so that operations at and after step S203 are carried out.

Steps S203 to S206 are directed to determination operations provided for performing the output voltage compensation process of step S201 at any one of the second to fourth timing. Steps S203 to S206 are basically similar in content to steps S103 to S106 in the first embodiment (FIG. 4). However, when the breath flow data Vb has become smaller than the offset value Voffset as determined at step S206 in the second embodiment, it is determined that the zero point has shifted in the minus direction due to a temperature drift and the like, so that the CPU 100 reverts to step S201. This is because the zero point of the breath flow data Vb is fixed at the offset value Voffset in the instant embodiment. With the above-described arrangements, the second embodiment can achieve generally the same advantageous benefits as the first embodiment.

Whereas the first and second embodiments have been described as applied to an electronic flute, the basic principles of the present invention are also applicable to other types of electronic wind instruments, such as an electronic piccolo and electronic ocarina.

This application is based on, and claims priority to, Japanese Patent Application No. 2006-256543 filed on Sep. 22, 2006. The disclosure of the priority application, in its entirety, including the drawings, claims, and the specification thereof, is incorporated herein by reference.

What is claimed is:

1. An electronic wind instrument comprising:

a pipe section;

a lip plate provided on the pipe section, wherein a blow hole is provided in the lip plate to provide an open space instrument type;

a breath flow detector that detects a flow of breath blown by a user through the blow hole of the lip plate;

a tone generator that forms a tone signal;

a control section that controls said tone generator on the basis of an output signal of said breath flow detector; and a zero point compensation section that, when a predetermined condition has been satisfied, compensates a zero point of the output signal of said breath flow detector on the basis of the output signal generated by said breath flow detector at a time point the predetermined condition has been satisfied.

2. An electronic wind instrument as claimed in claim 1 which further comprises a zero point compensation switch operable by the user, wherein, when said zero point compensation switch has been turned on, said zero point compensation section judges that the predetermined condition has been satisfied and then compensates the zero point of the output signal of said breath flow detector on the basis of the output signal generated by said breath flow detector at a time point said zero point compensation switch has been turned on.

3. An electronic wind instrument as claimed in claim 1 which further comprises a playing state detection section that detects whether or not a performance is being executed by the user, and wherein, when said playing state detection section has detected that no performance is being executed by the user, said zero point compensation section judges that the predetermined condition has been satisfied and then compensates the zero point of the output signal of said breath flow detector on the basis of the output signal generated by said breath flow detector at a time point said playing state detection section has detected that no performance is being executed by the user.

4. An electronic wind instrument as claimed in claim 1 wherein, when a value indicated by the output signal of said breath flow detector has decreased below a predetermined threshold value, said zero point compensation section judges that the predetermined condition has been satisfied and then compensates the zero point of the output signal of said breath flow detector on the basis of the output signal generated by said breath flow detector at a time point the value indicated by the output signal of said breath flow detector has decreased below the predetermined threshold value.

5. An electronic wind instrument as claimed in claim 1 wherein, when said electronic wind instrument has been turned on, said zero point compensation section judges that the predetermined condition has been satisfied and then compensates the zero point of the output signal of said breath flow detector on the basis of the output signal generated by said breath flow detector at a time point said electronic wind instrument has been turned on.

6. An electronic wind instrument as claimed in claim 1 wherein, when the predetermined condition has been satisfied, said zero point compensation section sets, as a value indicative of the zero point of the output signal of said breath flow detector, a value of the output signal generated by said breath flow detector at a time point the predetermined condition has been satisfied and then supplies said control section with the value indicative of the zero point, and wherein said control section controls said tone generator on the basis of the output signal of said breath flow detector and the value indicative of the zero point.

7. An electronic wind instrument as claimed in claim 1 which further comprises a shift controller that shifts the output signal of said breath flow detector in a plus or minus direction, and wherein, when the predetermined condition has been satisfied, said zero point compensation section controls an amount of shifting, by said shift controller, of the output signal of said breath flow detector so that the output signal of said breath flow detector, having been shift-controlled by said shift controller, takes a predetermined value, and wherein said control section controls said tone generator on the basis of the output signal of said breath flow detector having been shift-controlled by said shift controller.

8. A zero point compensation method of providing zero point compensation for an electronic wind instrument including a pipe section and a lip plate provided on the pipe section, wherein a blow hole is provided in the lip plate to provide an open space instrument type, the method comprising:

detecting a flow of breath blown by a user through the blow hole provided on the lip plate with a breath flow detector;

forming a tone signal with a tone signal generator;

controlling the tone generator on the basis of an output signal of the breath flow detector with a control section;

compensating a zero point of the output signal of the breath flow detector on the basis of the output signal generated by the breath flow detector at a time point when a predetermined condition has been satisfied by performing a zero point compensation process with the control section.

9. A zero point compensation method as claimed in claim 8 wherein, when the predetermined condition has been satisfied, said zero point compensation process sets, as a value indicative of the zero point of the output signal of the breath flow detector, a value of the output signal generated by the breath flow detector at a time point the predetermined condition has been satisfied and then supplies the control section with the value indicative of the zero point.

10. A zero point compensation method as claimed in claim 8 wherein said zero point compensation process includes: a setting step of, when the predetermined condition has been satisfied, setting an amount of shifting of the output signal of the breath flow detector such that the output signal takes a predetermined value; and a change step of changing a value of the output signal of the breath flow detector in accordance with the amount of shifting set by said setting step, and wherein the control section controls the tone generator on the basis of the output signal of the breath flow detector having been changed by said change step.

11. A non-transitory computer-readable storage medium containing a group of instructions for causing a computer to perform a zero point compensation method of providing zero point compensation for an electronic wind instrument including a pipe section and a lip plate provided on the pipe section, wherein a blow hole is provided in the lip plate to provide an open space instrument type, the method comprising:

detecting a flow of breath blown by a user through the blow hole provided on the lip plate with a breath flow detector;

forming a tone signal with a tone signal generator;

controlling the tone generator on the basis of an output signal of the breath flow detector with a control section;

compensating a zero point of the output signal of the breath flow detector on the basis of the output signal generated by the breath flow detector at a time point when a predetermined condition has been satisfied by performing a zero point compensation process with the control section.

12. A non-transitory computer-readable storage medium as claimed in claim 11 wherein, when the predetermined condition has been satisfied, said zero point compensation process sets, as a value indicative of the zero point of the output signal of the breath flow detector, a value of the output signal generated by the breath flow detector at a time point the predetermined condition has been satisfied and then supplies the control section with the value indicative of the zero point.

13. A non-transitory computer-readable storage medium as claimed in claim 11 wherein said zero point compensation process includes: a setting step of, upon satisfaction of the predetermined condition, setting an amount of shifting of the output signal of the breath flow detector such that the output signal takes a predetermined value; and a change step of changing a value of the output signal of the breath flow detector in accordance with the amount of shifting set by said setting step, and wherein the control section controls the tone generator on the basis of the output signal of the breath flow detector having been changed by said change step.

* * * * *